US009975127B2

(12) United States Patent
Hillström et al.

(10) Patent No.: US 9,975,127 B2
(45) Date of Patent: May 22, 2018

(54) CENTRIFUGAL SEPARATOR AND METHOD FOR DETERMINING SUITABLE MOMENT FOR REMOVAL OF HEAVY PHASE CONTENT

(71) Applicant: Alfa Laval Corporate AB, Lund (SE)

(72) Inventors: Lars Hillström, Uppsala (SE); Hans Moberg, Stockholm (SE); Finn Rundström, Enskede (SE); Peter Thorwid, Sundbyberg (SE); Roland Isaksson, Ribeirao Preto-SP (SE); Jan Skoog, Skogås (SE)

(73) Assignee: ALFA LAVAL CORPORATE AB, Lund (SE)

( * ) Notice: Subject to any disclaimer, the term of this patent is extended or adjusted under 35 U.S.C. 154(b) by 204 days.

(21) Appl. No.: 14/787,358

(22) PCT Filed: May 27, 2014

(86) PCT No.: PCT/EP2014/060936

§ 371 (c)(1),
(2) Date: Oct. 27, 2015

(87) PCT Pub. No.: WO2014/191403

PCT Pub. Date: Dec. 4, 2014

(65) Prior Publication Data

US 2016/0074881 A1 Mar. 17, 2016

(30) Foreign Application Priority Data

May 27, 2013 (EP) ..... 13169317

(51) Int. Cl.
*B04B 9/14* (2006.01)
*B04B 11/04* (2006.01)
(Continued)

(52) U.S. Cl.
CPC ..... *B04B 13/00* (2013.01); *B04B 1/14* (2013.01); *B04B 9/146* (2013.01); *B04B 11/04* (2013.01); *B04B 11/043* (2013.01)

(58) Field of Classification Search
CPC ..... B04B 1/14; B04B 9/146; B04B 13/00; B04B 11/04; B04B 11/043
(Continued)

(56) References Cited

U.S. PATENT DOCUMENTS 2,723,799 A * 11/1955 Sharples ..... B04B 1/18 494/10
3,189,268 A 6/1965 Nilsson
(Continued)

FOREIGN PATENT DOCUMENTS

CN 1272071 A 11/2000
CN 101384371 A 3/2009
(Continued)

*Primary Examiner* — Walter D Griffin
*Assistant Examiner* — Shuyi S Liu
(74) *Attorney, Agent, or Firm* — Birch, Stewart, Kolasch & Birch, LLP

(57) ABSTRACT

A centrifugal separator for separating a fluid mixture into components, including a non-rotating part, a rotor which is attached to a shaft which is rotatably supported in the non-rotating part around a rotational axis, which rotor forms within itself a separation space delimited by a rotor wall. The separator includes an inlet extending into the rotor for supply of a fluid mixture to be separated in the separation space, at least one sensor measuring unbalance conditions in the frame; a level determining arrangement including two or more space defining elements of arbitrary form arranged on the interior surface of, or close to, the rotor wall, where each space defining element defines a space which communicates with the separation space or another of the space defining elements through at least one inlet opening arranged at a certain radius from the rotational axis and not outside that radius and where that certain radii of the space defining
(Continued)

elements are different. Methods for determining when a predetermined amount of heavy phase fluid (purification) or sludge (clarification) has been separated are also disclosed. The separator and methods make it possible to determine when the level of separated heavy phase fluid or sludge is high enough for emptying or discharge of the separator.

10 Claims, 5 Drawing Sheets

(51) Int. Cl.
*B04B 13/00* (2006.01)
*B04B 1/14* (2006.01)

(58) Field of Classification Search
USPC ..... 494/1, 2, 3, 10
See application file for complete search history.

(56) References Cited

U.S. PATENT DOCUMENTS

| | | | | |
|---|---|---|---|---|
| 3,255,958 | A | 6/1966 | Simon | |
| 3,408,001 | A * | 10/1968 | Nilsson | B04B 1/08 494/27 |
| 3,593,915 | A | 7/1971 | Steinacker | |
| 3,986,663 | A | 10/1976 | Jonsson et al. | |
| 4,375,870 | A * | 3/1983 | Bodelson | F16K 3/26 251/325 |
| 6,358,193 | B1 | 3/2002 | Nyberg | |
| 7,008,365 | B2 | 3/2006 | Hamatschek et al. | |
| 7,056,272 | B2 | 6/2006 | Moss | |
| 2009/0137377 | A1 | 5/2009 | Astrom | |
| 2013/0012371 | A1 | 1/2013 | Marro | |

FOREIGN PATENT DOCUMENTS

| | | | |
|---|---|---|---|
| CN | 102164679 | A | 8/2011 |
| DE | 4300199 | C1 | 9/1994 |
| JP | 41-10940 | B | 6/1966 |
| JP | 44-28837 | B | 11/1969 |
| JP | 58-24364 | A | 2/1983 |
| JP | 6-328010 | A | 11/1994 |
| JP | 2013-523437 | A | 6/2013 |

* cited by examiner

CENTRIFUGAL SEPARATOR AND METHOD FOR DETERMINING SUITABLE MOMENT FOR REMOVAL OF HEAVY PHASE CONTENT

TECHNICAL FIELD

The invention relates to a centrifugal separator and a method for a centrifugal separator and more particularly to a centrifugal separator comprising a centrifugal separator comprising a device for determining when removal of a separated heavy phase fluid (in purification) or sludge (in clarification) from the separator is due and a method for accomplishing this.

BACKGROUND

Today a separated heavy phase is removed by a) discharge of the heavy phase through nozzles in the rotor wall;

b) draining the heavy phase during operation through a valve that is opened and closed;

c) stopping the operation of the separator and removing the heavy phase either by opening the separator or draining the heavy phase.

Independently of which method used there is always a common problem of when to remove the heavy phase fluid or sludge. With experience it may perhaps be possible to guess, but it may be difficult to decide, especially if the content of heavy phase varies with time.

Methods for detecting a suitable moment for removal of the heavy phase during operation are disclosed, such as in U.S. Pat. No. 3,408,001 where a separator is described having a sludge displacing body arranged inside the sludge space of the rotor to provide a change of the unbalance of the rotor when the heavy phase interface reaches the body.

The change in the condition of balance of a centrifuge rotor, which indicates a suitable time for sludge discharge, can be determined in several different ways. For example, it may be determined by an experienced operator who listens to the sound emitted from the rotating rotor and who initiates the sludge discharge when he detects a familiar change in the sound or vibrations caused by changes in the unbalance.

Other methods for determining this moment may include so called influences, which are relations between the unbalance situation of the separator rotor and the frame vibrations.

To obtain a good view over how a particular separator behaves under different operational conditions it is helpful to map the influences at different rotational speeds and unbalances. When the influences are known they can be used to recognize and determine the changes of unbalances of the sorts mention above.

When this unbalance has reached a predetermined value sludge discharge is triggered.

The prior art provides an apparatus that tries to give information concerning the heavy phase content of the separating space. However, the change in unbalance may often be difficult to detect and interpret due to different operational conditions as it will vary with the fluid mixture to be separated. Also due to the influences being dependent on operational conditions such as temperature, aging or relative movements of components of the separator, the properties of which components therefore change, it is rather difficult to detect a one off change in the vibrations of the separator. The apparatus disclosed in the prior art only provides a change from one unbalance condition to another thus making it easy to miss or misinterpret the event.

SUMMARY

It is an object of the invention to at least partly overcome one or more of the above-identified limitations of the prior art. In particular, it is an object to provide an apparatus and method that gives a clearer and more unambiguous signal or information concerning the heavy phase content of the separating space and when it is time to remove the same.

To fulfil these objects a centrifugal separator for separating a fluid mixture into components is provided. The centrifugal separator comprises a non-rotating part comprising a frame, a rotor which is attached to a shaft which is rotatably supported in the non-rotating part around a rotational axis, which rotor forms within itself a separation space delimited by a rotor wall, an inlet extending into the rotor for supply of a fluid mixture to be separated in the separation space, at least one sensor measuring unbalance conditions in the frame, and a heavy phase level determining arrangement comprising a plurality of space defining elements arranged on the interior surface of, or close to the rotor wall, at least one on each side of the rotational axis substantially opposite each other and with walls extending radially inwardly, where each space defining element defines a space which communicates with the separation space or another of said space defining elements through at least one inlet opening arranged at a certain radius from the rotational axis and where the certain radii of the space defining elements opposite each other are different from each other, and which space defining elements are provided to displace the heavy phase component until the heavy phase level reaches the opening of the respective space defining element.

The invention may be used in both purification (separation of two fluids) and clarification (separation of solids, or sludge) applications with slightly different operations which are explained below.

The two space defining elements with inlet openings at different radii provides change of the vibrational state of the separator at two different moments fairly close to each other which is easier to detect and determine than only one such signal.

There may be only one space defining element symmetrically placed on each side of the rotational axis of the centrifugal rotor.

The shape of the space defining elements may be that of a truncated cone or a truncated tri-, quadric- or polylateral pyramid, where its walls through their radial extension provide a tapering and a roof is marking the truncation.

The roof of the space defining element may be inclined and or a mansard roof.

The space defining elements may have at least one evacuation opening placed radially more inwardly than the inlet opening and the evacuation opening may be facing upwardly.

To further fulfil the objects the method for determining when a predetermined amount of heavy phase fluid has been separated from a light phase fluid in a centrifugal separator comprises the steps of bringing the rotor to rotate;

filling the rotor with fluid to be separated;

where said heavy phase fluid is forming a growing peripheral layer on the inside of the rotor wall;

continually measuring unbalance conditions in the frame;

determining a first signal deriving from a first change in vibrations in the frame, said first change signal indicating a first level of separated heavy phase fluid being present in the rotor, where said first change derives from a first change in distribution of said heavy phase fluid layer around the periphery of the rotor wall;

determining a second signal deriving from a second change in vibrations in the frame, said second change signal indicating a second level of separated heavy phase fluid slightly higher than said first level, being present in the, where said second change derives from a second change in distribution of said heavy phase fluid layer around the periphery of the rotor wall;

and upon determination of both the first and the second changes signals, initiation of emptying or discharging of the separator rotor of heavy-phase fluid.

There is also provided a method for determining when a predetermined amount of sludge has been separated from a fluid in a centrifugal separator, which comprises the steps of bringing the rotor to rotate;

filling the rotor with fluid to be separated;

where said sludge is forming a growing peripheral layer on the inside of the rotor wall;

stopping the flow of fluid to be separated;

continually measuring unbalance in the frame;

then adding an amount (B) of indicating fluid having higher density than the fluid to be separated but lower than the sludge;

where said indicating fluid is forming a layer on the inside of said sludge layer;

determining a first signal deriving from a first change in vibrations in the frame, said first change signal indicating a first level of separated sludge plus the indicating fluid being present in the rotor forming two periferal layers on the inside of the rotor wall, where said first change derives from a first change in distribution of the indicating fluid layer;

determining a second signal deriving from a second change in vibrations in the frame, said second change signal indicating a second level of separated sludge plus indicating fluid slightly higher than said first level, where said second change derives from a second change in distribution of the indicating fluid layer;

and upon determination of both the first and the second changes signals, initiation of emptying or discharging of the separator rotor of sludge.

Still other objectives, features, aspects and advantages of the invention will appear from the following detailed description as well as from the drawings.

DRAWINGS

Embodiments of the invention will now be described, by way of example, with reference to the accompanying schematic drawings, in which FIG. 1 is a schematic view of a centrifugal separator according to the invention FIG. 2 is a cross-sectional view from the top of a separating space of a separator after fluid to be separated has been supplied to the rotor.

DETAILED DESCRIPTION

Figure 1:
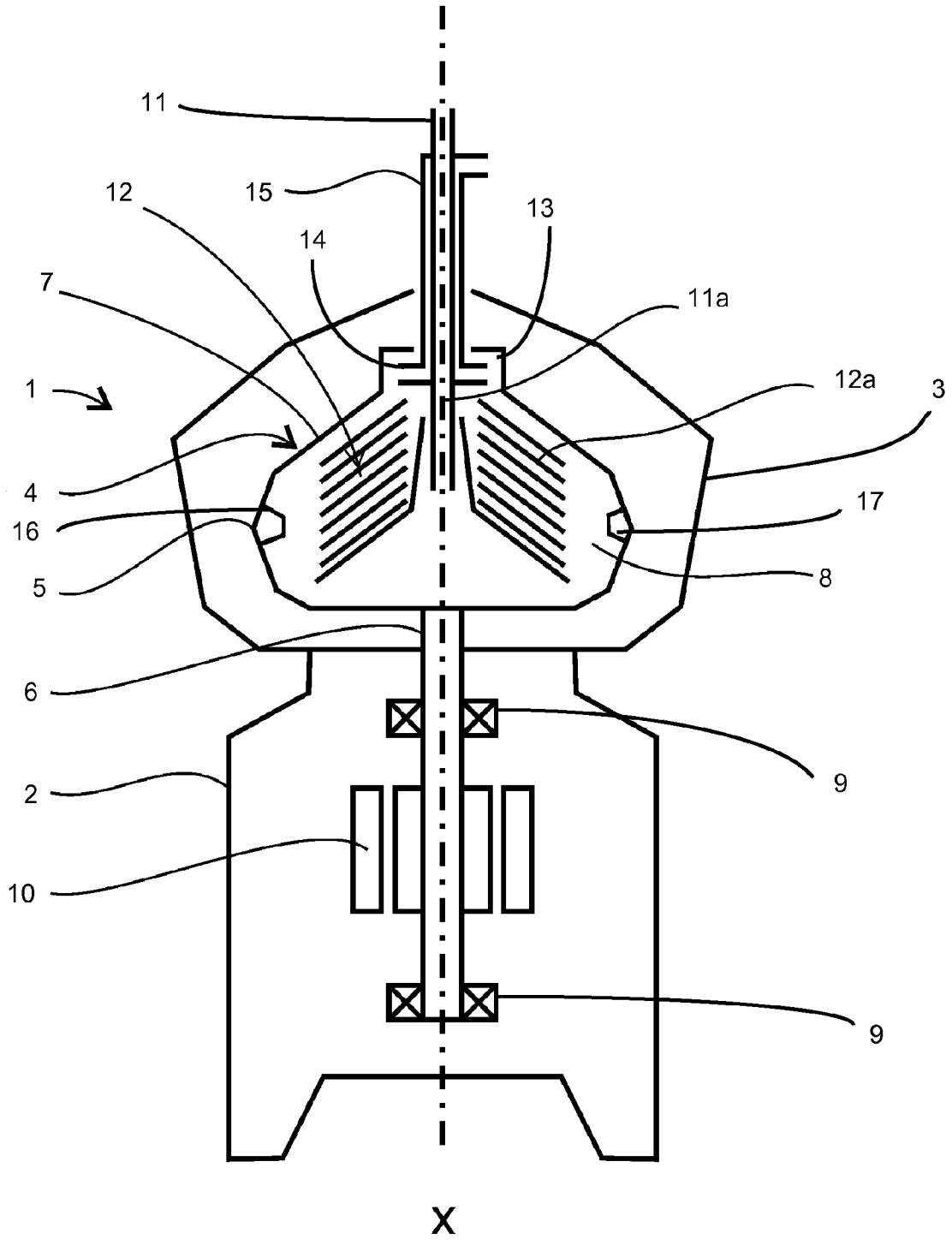

With reference to FIG. 1 a centrifugal separator 1 is illustrated. The centrifugal separator comprises a non-rotating part 2, 3 and a rotating part 4. The non-rotating part comprises a frame 2, which is located and fastened to the ground, e.g. a floor, and a cover 3. The rotating part 4 is configured to rotate around the axis of rotation x and comprises a rotatable centrifuge rotor 5 enclosed by the cover 3 and a shaft 6 to which the centrifuge rotor 5 is attached. The centrifuge rotor 5 encloses by rotor walls 7 a separation space 8 in which the separation of a fluid mixture takes place. The shaft 6 is journalled in a bearing arrangement 9 secured to the non-rotating part 2, 3. The shaft 6 is driven by a motor 10. An inlet comprising a stationary inlet pipe 11 with an inlet channel 11*a* is supplying a fluid to be separated into a light liquid phase and a heavy liquid phase or into one or two liquid phases and sludge, into the centrifuge rotor 5.

The fluid entering the centrifuge rotor 5 flows into the separation space 8, in which a disk set 12, comprising stacked separator discs 12*a*, is inserted. In operation, the heavy phase separated in the disk set 12 forms a layer in the periphery of the separating space 8, while the light phase is collecting radially inside and in accordance with the embodiment of FIG. 1 further transported to an entrance 14 of an outlet 15. The entrance 14 is in an upper chamber 13 of rotor 5.

No provision for discharge of the heavy-phase is shown in FIG. 1. Within the scope of the invention is the possibility of, which has previously been mentioned, a) discharge of the heavy phase through nozzles in the rotor wall;

b) draining the heavy phase during operation through a valve that is opened and closed;

c) stopping the operation of the separator and removing the heavy phase either by opening the separator or draining the heavy phase.

Thus an eventual discharge arrangement does not form a part of the present invention and is not defined in detail.

Figure 9:
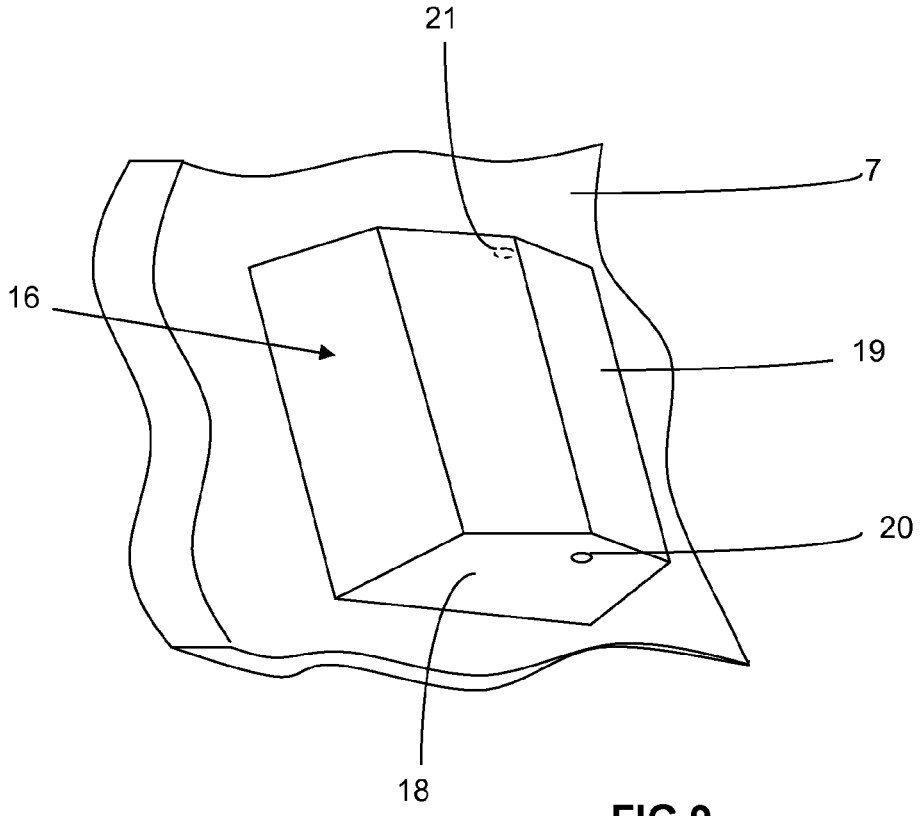
FIG. 9 is a perspective view of an embodiment of a space defining element comprised in a centrifugal separator according to the invention.

In the part of the separation space 8 radially outside the disk set 12 a level determining device comprising two space defining elements 16, 17 functioning as displacing bodies are arranged, having, in the example shown in FIG. 1 and in more detail in FIG. 9, the shape of truncated quadrilateral pyramids with walls 18 tapering radially inwardly and the truncated end covered by a roof 19 which in FIG. 9 is a mansard roof. At the truncated end preferably in a wall or walls 18 just radially outside the roof 19 is one or more inlet openings 20 arranged. The inlet opening(s) 20 of the left space defining element 16 is arranged at a certain radius a from the rotational axis x and the inlet opening(s) of the right space defining element 17 is arranged at a certain radius b from the rotational axis x, where b is larger than a. The shape of the space defining elements 16, 17 may instead be a truncated cone or a truncated tri- or polylateral pyramid or any arbitrary form.

In the case of clarification, i.e. the case where sludge is separated from a liquid, the space defining element maybe arranged where a discharge nozzle is placed so the space defining element easily will be emptied at discharge.

In order that air or gas and later fluid to be separated will evacuate from the space defining elements 16, 17, shown in FIG. 9, an evacuation opening 21 is arranged in the wall 18 closer to the axis of rotation x in such a way that the edge of the inlet opening 20 most distant from the axis of rotation is closer to the rotor walls 7 than the corresponding edge of the evacuation opening 21. The fluid therefore flows in through the inlet opening 20 when it fills the space defining elements 16, 17. The evacuation opening 21 is letting the air or gas out and also letting the fluid to be separated out when the heavy-phase fluid flows in. To facilitate this, the evacuation opening 21 is preferably arranged in a part of the space defining element 16, 17 as close to the rotational axis as possible facing the top of the rotor 5. It will then be pushed inwards upwards by the heavy phase fluid replacing it and evacuated through the evacuation opening 21. The inner surface of the space defining element may also be so inclined towards the evacuation opening 21 that the air/gas or fluid to be separated will more easily escape.

The inlet opening 20 are instead preferably arranged in a part of the wall part 18 of the space defining elements 16, 17 facing the bottom of the rotor 5 to facilitate emptying when the centrifugal separator 1 is stopping.

The rotor 1 has in itself often an unbalance, due to the center of gravity and the construction of the rotor. The unbalance is the source of vibrations during operation and when the rotor is supplied with fluid uneven distribution of the content leads to a different unbalance situation and a change in the arisen vibrations. The invention exploits this fact by creating changes in the unbalance, and monitoring the vibrational changes this leads to. In the embodiment disclosed in FIG. 2-7 both the heavy phase and the light phase are liquids.

In the following description operation it is first provided that two liquids, a heavy and a light phase are separated.

Figure 2:
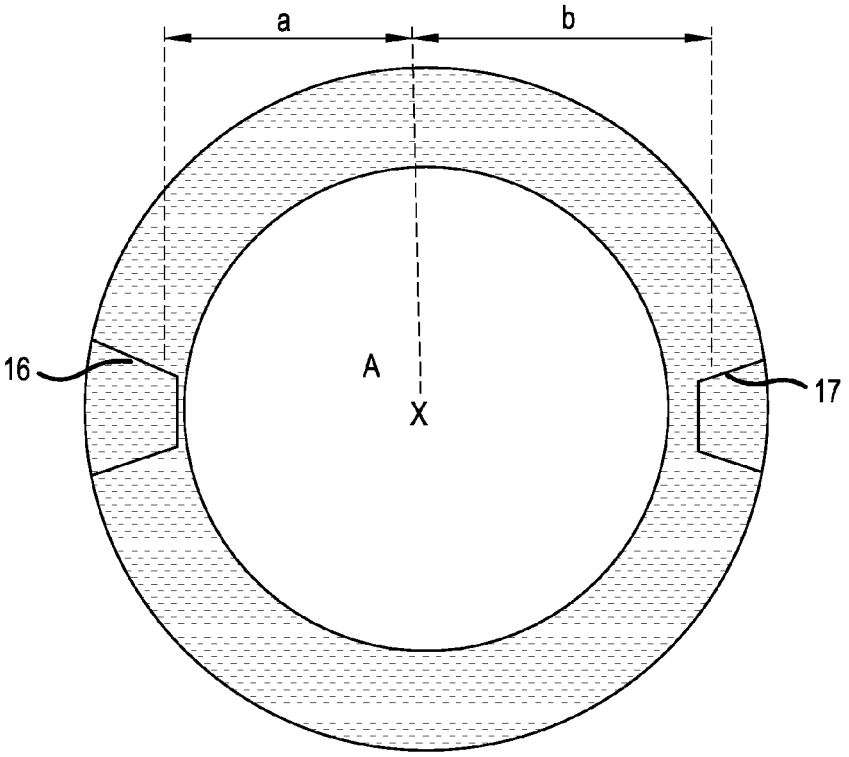

To describe the operation of the invention, the centrifuge rotor is depicted in different phases of operation schematically in FIG. 2-7. In FIG. 2 the rotor has just started rotating and is filled with fluid to be separated into light phase and heavy phase fluid. Also the space defining elements 16, 17 are filled with the fluid to be separated as the fluid level exceeds the radius in which the inlet opening 20 are arranged, thus replacing air/gas in the space defining elements. The fluid is thus evenly placed against the inner perimeter of the rotor walls 7 of the rotor 5. The vibrations are continually measured by a sensor. The sensor may be a vibration sensor or another type of sensor that produces a signal that is related to the unbalance condition. A is marking a natural unbalance position of the rotor 5. This position is moving during operation as will be described later in relation to the different phases, and the changes of the position are detected and interpreted to establish when it is suitable to remove the heavy phase fluid or sludge from the rotor 5.

Figure 3:
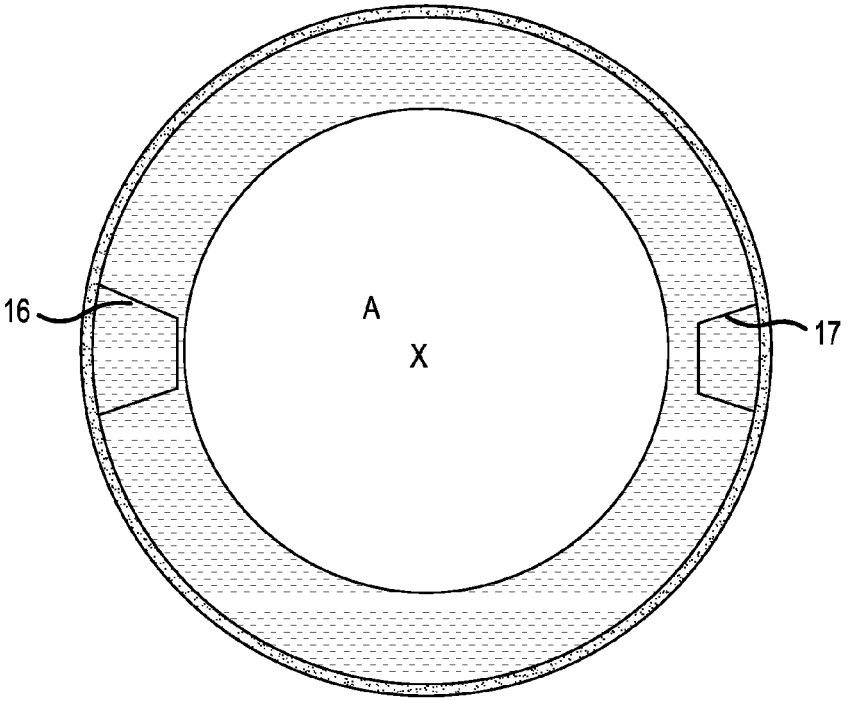
FIG. 3 is a cross-sectional view from the top of a separating space of a separator after a first phase of separation.

FIG. 3 discloses an operational phase somewhat later when the separation process has been going on for some time. Heavy-phase fluid has been separated from the light phase fluid and is due to its higher density collected around the inner perimeter of the rotor walls with the light phase fluid radially inside thereof. The unbalance position is still unchanged at position A, since the heavy phase and light phase are still symmetrically situated around the inner perimeter of the rotor.

Figure 4:
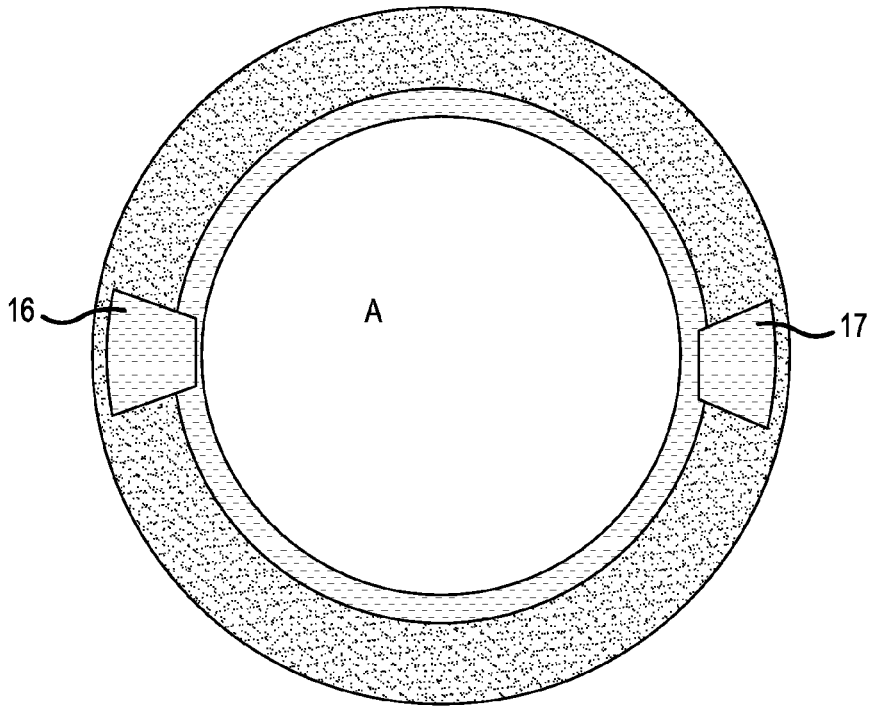
FIG. 4 is a cross-sectional view from the top of a separating space of a separator after a second phase of separation.

In FIG. 4 an operational phase still some time later is disclosed. More heavy-phase fluid has been separated which shows as a thicker layer inwardly from the inner perimeter of the rotor walls 7. The heavy-phase fluid level has not, however, yet reached the inlet opening 20, which are the only passages into the space defining elements 16, 17 (except for the evacuation openings). The heavy-phase fluid level is, however, just about to reach the inlet opening 20 in the right space defining element 17 which inlet opening is placed radially at a greater distance, i.e. radius b, from the rotational axis x than the inlet opening of the left space defining element 16, which is placed at radius a from the rotational axis x. The unbalance position is still unchanged at position A, since the heavy phase and the light phase are symmetrically situated around the inner perimeter of the rotor walls 7.

Figure 5:
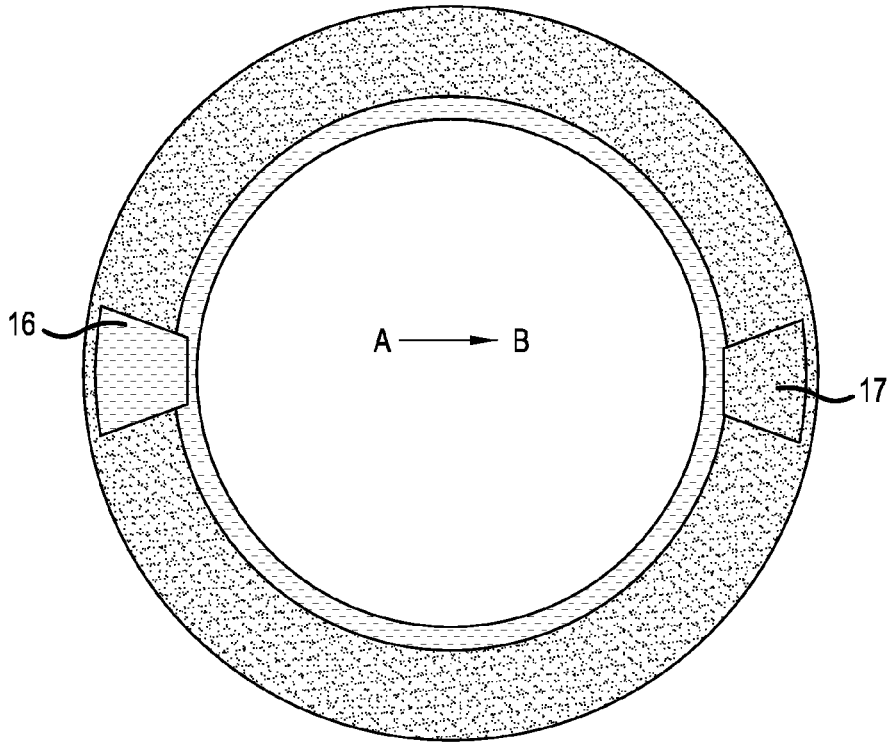
FIG. 5 is a cross-sectional view from the top of a separating space of a separator after a third phase of separation.

In FIG. 5 the unbalance position has just moved to position B. The reason for this is that the heavy-phase level has now reached the inlet opening 20 of the right space defining element 17. The heavy-phase fluid then communicates with the interior of the light-phase fluid inside the space defining element 17 and being heavier it replaces the lighter fluid in the space defining element 17. The heavy phase fluid is now differently distributed around the rotor perimeter. Thus, since the space defining elements 16, 17 now contain fluids of different densities the unbalance position has moved towards the right space defining element 17. This change in the unbalance position which causes a change in the vibration characteristics is detected and determined by a vibration sensor.

Figure 6:
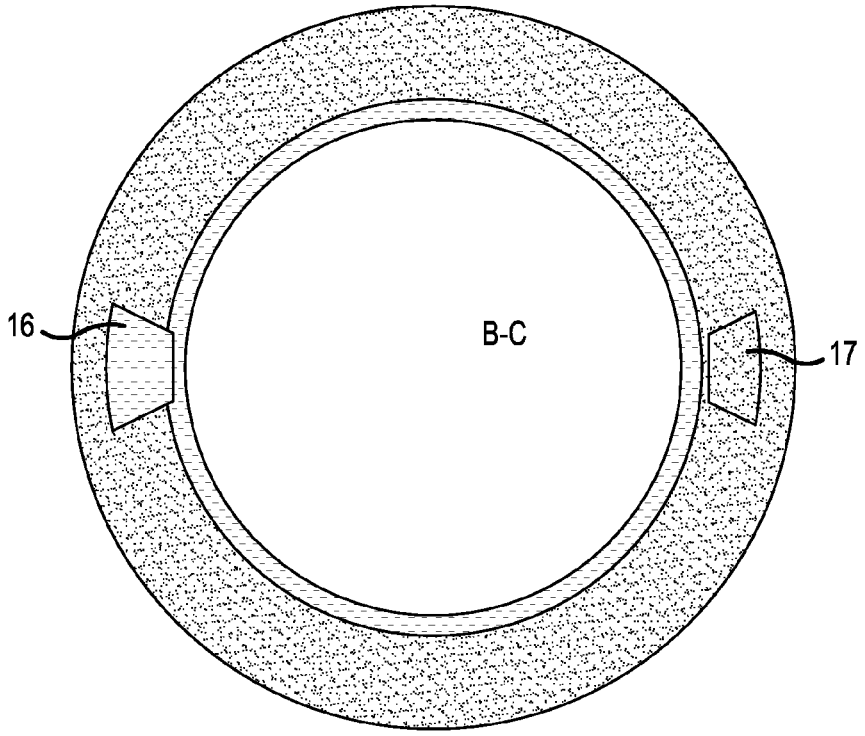
FIG. 6 is a cross-sectional view from the top of a separating space of a separator after a fourth phase of separation.

In FIG. 6 the unbalance position has moved slightly further to the right, as still more heavy-phase fluid has been separated and the level not yet has reached the inlet opening 20 of the left space defining element 16. This results in a slight displacement further to the right as there has gathered more heavy-phase fluid radially inside the right space defining element 17 which has no correspondence on the left side.

Figure 7:
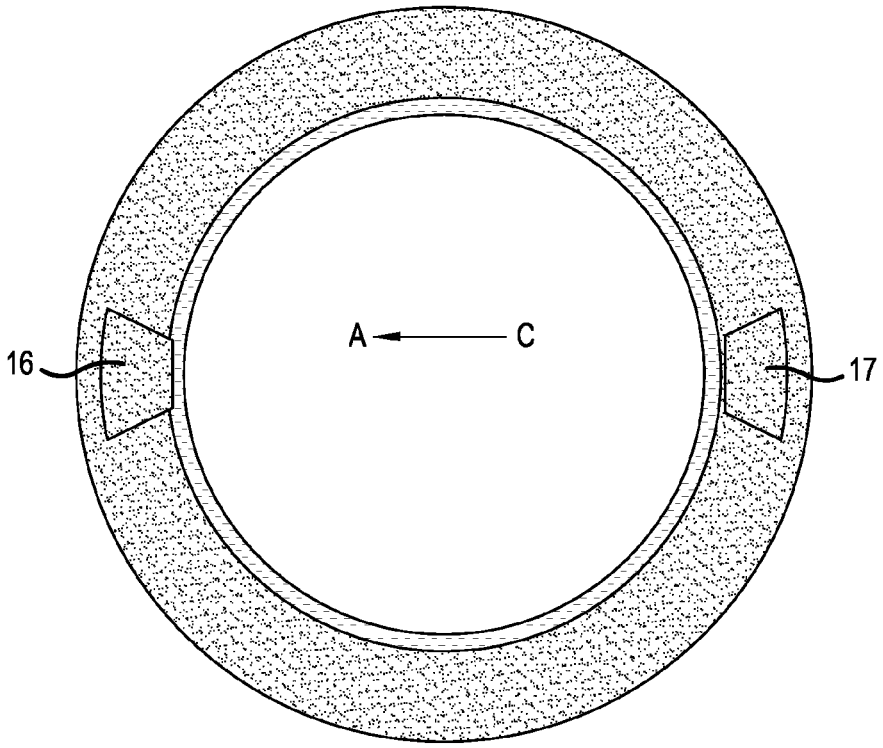
FIG. 7 is a cross-sectional view from the top of a separating space of a separator after a fifth phase of separation.

FIG. 7 finally discloses a phase when the heavy-phase fluid level also has reached the inlet opening 20 of the left space defining element 16 and thus filled it with heavy-phase fluid replacing the light-phase fluid which until then has been present there. Yet another change of the distribution of the heavy phase fluid has taken place. Thus, the heavy-phase and light-phase fluids are again symmetrically disposed around the inner perimeter of the rotor walls 7 and the unbalance position has moved back to its originally position A. This change of unbalance position is detected and determined by a vibration sensor in accordance with e.g. one of the methods described below.

Upon detection of both the first change and the second change, initiation of emptying or discharging of the separator rotor of heavy-phase fluid is suitable either manually or automatically by a control system which has been given instructions to start this operation step when the two conditions are fulfilled. Thus the level determining arrangement determines when the level of the heavy phase has reached a certain level in the separation space 8 and may be called heavy phase level determining arrangement.

According to the second operation of the invention when the fluid contains sludge which is desirable to separate, the rotor 5 of the separator 1 is started and accelerated up to normal speed. The rotor 5 is then filled with the fluid to be separated and the flow then turned off. A small amount of an indicating fluid (e.g. water) with a density higher than the fluid to be separated but lower than the sludge is then added and because of the density difference forced against the inner perimeter of the rotor walls 7. The amount of indicating fluid is not large enough to flow into the inlet openings 20 of the space defining elements 16, 17. However, the amount of indicating fluid is large enough to fill up the space defining elements. The unbalance position is therefore still at its original position. In this embodiment the heavy phase component may be defined as sludge plus the indicating fluid.

The flow of the fluid to be separated is then again started and the separation of sludge is beginning. Gradually as the sludge is separated it is collected against the inner perimeter of the rotor walls 7, superseding the indicating fluid which has a lower density than the sludge. The unbalance position is still at its original position since the fluids and sludge are symmetrically situated around the inner perimeter of the rotor walls 7.

At a certain phase of the operation there is enough sludge to bring the level of the indicating fluid in level with the inlet opening 20 of the right space defining element 17. The indicating fluid then communicates with the interior of the right space defining element 17 and being heavier than the fluid to be separated which it previously has been filled with, it replaces the fluid in the space defining element 17. The indicating fluid is now differently distributed in the around the rotor perimeter. Thus, since the two space defining elements 16, 17 now contain fluids of different densities the unbalance position has moved towards the right space defining element 17.

Finally, when the indicating fluid level also has reached the inlet opening 20 of the left space defining element 16 and thus filled the same with indicating fluid replacing the fluid to be separated which until then has been present there, the fluids and sludge are symmetrically disposed around the inner perimeter of the rotor walls 7 again and the unbalance position has moved back to its originally position A. Yet a change in the distribution of the indicating fluid around the perimeter has taken place. Thus the level determining arrangement determines when the level of the heavy phase component has reached a certain level in the separation space 8 and may be called heavy phase level determining arrangement.

Figure 8:
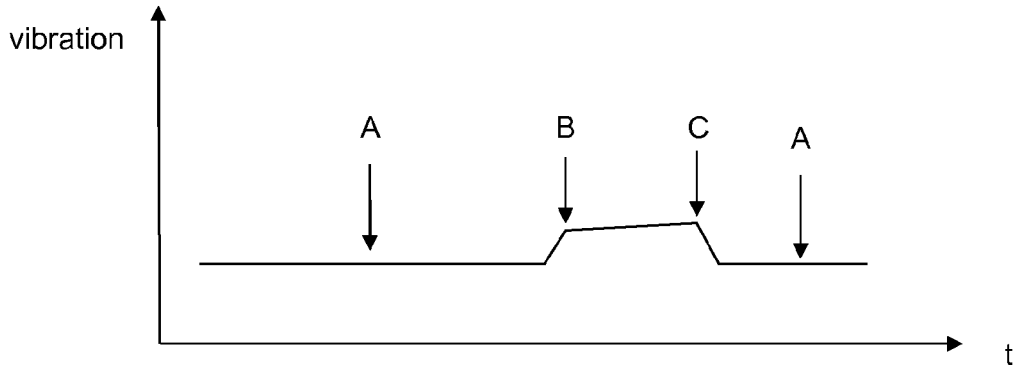
FIG. 8 is a graph representing a course of events according to the invention.

In FIG. 8 is disclosed in a graph, an example of what a vibration sensor would be able to register during one of the separation operations described above. The different points of time that are marked along the horizontal time axis correspond with the situations shown in FIG. 2-7. The arrows A-C show the unbalance situation at some points of time. The figure illustrates that the unbalance, and thus also the vibrations, changes relatively fast when the space defining elements are filled with heavy-phase fluid, which is an advantage because it is easier to detect fast changes than slower (it is possible to influence the points of time by choosing the position of the inlet opening 20).

In FIG. 8 an example of what a vibration sensor would measure as a function of time is shown. The graph actually shows the overall root mean square value of the vibrations as function of time. Another way to describe the relevant part of the vibrations for the invention is to use the amplitude and the phase of the vibrations at the rotor revolution frequency. The phase relates the amplitude to a reference of the rotor. The reference is typically established by measuring a pulse from a revolution time signal (one pulse per revolution). There are many ways to achieve the amplitude and phase. It may require filtering techniques and it is routinely done by for example order tracking systems, which are frequently used for balancing purposes. The amplitude and the phase description of the vibration at the rotor revolution frequency provides a more exact and desired description of the unbalance state of the bowl and may therefore, in some applications, be more suitable to the invention.

In case of substantial temperature variations it may be necessary to monitor the ambient temperature and compensate for the effect this may have on the vibrations. Otherwise a substantial and fast temperature change may be perceived as a vibrational change by the vibration sensors.

The form of the space defining elements 16, 17 is preferably tapered radially inwardly as previous has been discussed.

However, non-tapered space defining elements would also function, e.g. would it be possible to have rectangular elements, where the inner surfaces are inclined to facilitate evacuation through the evacuation opening or emptying through the inlet opening. It is also not necessary to be limited to two space defining elements. It would be possible to arrange more than one on each side of the rotor, where the elements on each side have their inlet openings on the same radius.

The space defining elements may be volumes close to the interior surface of the rotor wall which may be specially arranged in the rotor for the purpose or volumes resulting from the construction of the rotor between rotor details possible to utilize for the purpose.

It would also be possible to have three or more space defining elements evenly or unevenly distributed around the inner perimeter of the rotor walls, i.e. at different angular positions around the rotational axis, and where the inlet openings of each element are placed on different radii. This would mean that there will be more changes of the unbalance than described previously, before the unbalance situation once again return to the original state.

The space defining elements may be arranged in the same radial plane or in different radial planes.

The space defining elements may be arranged with at least two at the same angular position around the rotational axis.

Each space defining element 16, 17 or one or some of them may be placed over a discharge port facilitating the emptying of them.

The space defining elements may be fixedly attached to the rotor wall, or attached by means by which it is possible to mount them or dismount them when suitable.

Furthermore, in a wall of the space defining elements closest to the rotor wall 7 there may be room for a magnet which may be detected by a tachometer.

The invention may be used for determining the density of either the light phase fluid or the heavy phase fluid if the density of one of them is known. The separator rotor is then during rotation slowly supplied with fluid to be separated. The two space defining elements 16, 17 are one after another filled with the fluid to be separated displacing the gas (air) which they originally were filled with. The vibration changes are measured during this operation and especially the change when the second space defining element also is filled is measured and represented below as $v_c - v_a$. The separator bowl is continuously supplied with fluid to be separated and the fluid is separated into heavy phase and light phase.

When the separation operation has been going on for some time and enough heavy phase fluid has been separated so that the heavy phase fluid level reaches the inlet of the first space defining element this fills up replacing the fluid to be separated (which has been separated into heavy and light phase fluid) soon to be followed by the second space defining element filling up when the heavy phase fluid level reaches its inlet. The vibration change of the filling of this second space defining element is measured and represented below as $v_c - v_a$. It can be shown that the change of the root mean square value of the vibrations (as mentioned above) is directly proportional to the change in density $$\frac{\rho_{feed} - \rho_{air}}{\rho_{heavy} - \rho_{light}} = \frac{v_{c'} - v_a}{v_c - v_a}$$

Where $\rho_{feed}$ may be approximated to $\rho_{light}$ if the content of heavy phase is only a few percent. As $v_{c'} - v_a$ and $v_c - v_a$ is measured as mentioned above, it is possible to solve this equation if either the density of the heavy phase fluid or light phase fluid is known. This information may be used in a number of ways for controlling the process.

The space defining elements may be communicating with each other in such a way that a first space defining element first will be filled and a second space defining element will be filled through a communication extending from an outlet opening of the first space defining element to an inlet opening of the second space defining element where the outlet opening is arranged at a radius from the rotational axis that is smaller than that where the inlet opening is arranged. More than one space defining element may have such communications with several others.

From the description above follows that, although various embodiments of the invention have been described and shown, the invention is not restricted thereto, but may also be embodied in other ways within the scope of the subject-matter defined in the following claims.

The invention claimed is:

1. A centrifugal separator for separating a fluid mixture into components, comprising:

a non-rotating part;

a rotor, said rotor being attached to a shaft rotatably supported in the non-rotating part around a rotational axis, the rotor forming within itself a separation space delimited by a rotor wall;

an inlet extending into the rotor for supply of a fluid mixture to be separated in the separation space;

at least one sensor measuring unbalance conditions in the non-rotating part; and a heavy phase level determining arrangement comprising two or more space defining elements arranged on an interior surface of, or close to, the rotor wall, wherein each space defining element defines a space which communicates with the separation space or another of said space defining elements through at least one inlet opening arranged at a certain radius from the rotational axis, and wherein certain radii of the space defining elements are different, and the space defining elements being provided to displace a heavy phase component until a heavy phase level reaches the inlet opening of the respective space defining element.

2. The centrifugal separator according to claim 1, wherein at least two space defining elements are arranged at different angular positions around the rotational axis.

3. The centrifugal separator according to claim 1, wherein at least two space defining elements are arranged opposite each other, one space defining element on each side of the rotational axis.

4. The centrifugal separator according to claim 1, wherein the space defining elements are diametrically opposed.

5. The centrifugal separator according to claim 1, wherein a shape of the space defining elements is that of a truncated cone or a truncated tri-, quadric- or polylateral pyramid, and wherein walls of the space defining elements provide a tapering and a roof marks the truncation.

6. The centrifugal separator according to claim 1, wherein a roof of each of the space defining elements is inclined.

7. The centrifugal separator according to claim 5, wherein the roof of each of the space defining elements is a mansard roof.

8. The centrifugal separator according to claim 1, where the space defining elements have at least one evacuation opening, each evacuation opening being placed radially more inwardly than the inlet opening.

9. A method for determining when a predetermined amount of heavy phase fluid has been separated in a centrifugal separator according to claim 1, said method comprising the steps of:

bringing the rotor to rotate;

filling the rotor with fluid to be separated; and where said heavy phase fluid is forming a growing peripheral layer on the inside of the rotor wall:

continually measuring the unbalance condition in the non-rotating part;

determining a first signal deriving from a first change in vibrations in the non-rotating part, said first change signal indicating a first level of separated heavy phase fluid being present in the rotor, where said first change derives from a first change in distribution of said heavy phase fluid layer around the periphery of the rotor wall;

determining a second signal deriving from a second change in vibrations in the non-rotating part, said second change signal indicating a second level of separated heavy phase fluid slightly higher than said first level, being present in the rotor, where said second change derives from a second change in distribution of said heavy phase fluid layer around the periphery of the rotor wall; and upon determination of both the first and the second signals, initiation of emptying or discharging of the separator rotor of heavy-phase fluid.

10. A method for determining when a predetermined amount of sludge has been separated in a centrifugal separator according to claim 1, said method comprising the steps of:

bringing the rotor to rotate;

filling the rotor with fluid to be separated;

where said sludge is forming a growing peripheral layer on the inside of the rotor wall:

stopping the flow of fluid to be separated;

continually measuring the unbalance condition in the non-rotating part; and then adding an amount of indicating fluid having higher density than the fluid to be separated but lower than the sludge;

where said indicating fluid is forming a layer on the inside of said sludge layer:

determining a first signal deriving from a first change in vibrations in the non-rotating part, said first change signal indicating a first level of separated sludge plus the indicating fluid being present in the rotor, where said first change derives from a first change in distribution of the indicating fluid layer;

determining a second signal deriving from a second change in vibrations in the non-rotating part, said second change signal indicating a second level of separated sludge plus indicating fluid slightly higher than said first level, where said second change derives from a second change in distribution of the indicating fluid layer; and upon determination of both the first and the second signals, initiation of emptying or discharging of the separator rotor of sludge.

* * * * *